US009285156B2

(12) United States Patent
Linke

(10) Patent No.: US 9,285,156 B2
(45) Date of Patent: Mar. 15, 2016

(54) COOLING DEVICE

(71) Applicant: Miele & Cie. KG, Guetersloh (DE)

(72) Inventor: Patrick Linke, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 14/252,787

(22) Filed: Apr. 15, 2014

(65) Prior Publication Data

US 2014/0306596 A1 Oct. 16, 2014

(30) Foreign Application Priority Data

Apr. 16, 2013 (DE) ..... 10 2013 103 819

(51) Int. Cl.
*F25D 23/02* (2006.01)
*E05F 15/611* (2015.01)
*E05F 15/619* (2015.01)

(52) U.S. Cl.
CPC ..... *F25D 23/028* (2013.01); *E05F 15/611* (2015.01); *E05F 15/619* (2015.01); *E05Y 2201/412* (2013.01); *E05Y 2201/426* (2013.01); *E05Y 2201/46* (2013.01); *E05Y 2800/205* (2013.01); *E05Y 2900/31* (2013.01)

(58) Field of Classification Search
CPC . F25D 23/02; F25D 23/028; F25D 2323/024; F25D 23/062; F25D 23/065; E05F 15/121; E05F 15/611
USPC ..... 312/405, 405.1, 319.2, 326, 329, 319.5, 312/319.7; 49/276; 292/DIG. 72
See application file for complete search history.

(56) References Cited

U.S. PATENT DOCUMENTS 5,248,196 A * 9/1993 Lynn ..... F25D 23/065 264/276
5,284,023 A * 2/1994 Silva ..... F25D 19/02 312/236
5,573,323 A * 11/1996 Kim et al. ..... 312/405
6,338,536 B1 * 1/2002 Ueno et al. ..... 312/405
6,845,545 B2 * 1/2005 Han et al. ..... 16/277
2002/0171335 A1 * 11/2002 Held ..... A47B 77/08 312/223.6
2006/0097612 A1 * 5/2006 Park ..... 312/405
2009/0031634 A1 * 2/2009 Glanz et al. ..... 49/324
2009/0284116 A1 * 11/2009 Gorz ..... F25D 23/062 312/405
2009/0302724 A1 * 12/2009 Allard ..... F25D 17/042 312/237
2010/0018240 A1 * 1/2010 Hecht et al. ..... 62/449
2011/0014985 A1 1/2011 Park et al.
2011/0083461 A1 * 4/2011 Kim ..... 62/264
2011/0113816 A1 5/2011 Stocker
2012/0038257 A1 * 2/2012 Kim et al. ..... 312/405
2012/0080989 A1 * 4/2012 Davis et al. ..... 312/405

FOREIGN PATENT DOCUMENTS

DE 102005057150 A1 6/2007
DE 202006010482 U1 11/2007

(Continued)

*Primary Examiner* — James O Hansen
(74) *Attorney, Agent, or Firm* — Leydig, Voit & Mayer, Ltd.

(57) ABSTRACT

A refrigeration appliance includes a body having an interior compartment, a door, and a mechanism for opening and/or closing the door that is adapted to act on the door. The interior compartment is adapted to receive products to be cooled. The door is movably attached to the body and adapted to close the interior compartment. The mechanism for opening and/or closing the door is an integral module and is disposed in a corresponding pocket of the refrigeration appliance.

15 Claims, 3 Drawing Sheets

(56) References Cited

FOREIGN PATENT DOCUMENTS

| | | | |
|---|---|---|---|
| DE | 102009053714 | A1 | 4/2011 |
| DE | 102011014985 | A1 | 10/2012 |
| EP | 2299214 | A2 | 3/2011 |
| JP | 2003185333 | A | 7/2003 |
| KR | 1020090128907 | A | 12/2009 |

* cited by examiner

COOLING DEVICE

CROSS-REFERENCE TO RELATED APPLICATIONS

Priority is claimed to German Patent Application No. DE 10 2013 103 819.0, filed on Apr. 16, 2013.

FIELD

The present invention relates to a refrigeration appliance.

BACKGROUND

A refrigeration appliance having a body whose interior compartment receives the products to be cooled and can be closed by a door movably attached to the body, and further having at least one opening and/or closing mechanism acting on the door, is described, for example, in EP 2 299 214 A2. The opening and/or closing mechanism described in this publication is made up of an electric motor whose shaft carries a pinion. This pinion forms part of a gear drive mechanism which serves to move two parallel toothed racks in an axial direction. Each of the toothed racks serves to operate a respective one of two doors of the refrigeration appliance. Accordingly, this opening and/or closing mechanism must be disposed approximately centrally on the refrigeration appliance; i.e., on the side of the doors opposite the hinge side thereof. However, as a result of this very special design of a refrigeration appliance, the opening and/or closing mechanism can only be used for refrigeration appliances having several doors, where the doors open centrally and are therefore hinged at opposite sides of the body of the refrigeration appliance. Moreover, the entire opening and/or closing mechanism is complex in design and difficult to assemble from a production engineering point of view, because the gear mechanism employed includes a plurality of individual gears.

A comparatively simpler design is described in KR 10 2009 0128907 A, which describes an opening and/or closing mechanism where the shaft of the electric motor also carries a pinion which is in direct contact with a toothed rack. This toothed rack moves a piston. The piston acts directly on the door of the refrigeration appliance, thereby enabling an opening movement of this door. A magnet is provided at the end of the piston to assist the closing movement of the door. While such an approach is, on the whole, relatively simple in terms of construction, it has the disadvantage that the individual components cannot be installed into the refrigeration appliance until it is assembled, which altogether results in considerable complexity.

One proposal to obviate this disadvantage is made in DE 10 2009 053 714 A1. This document describes generally a household appliance whose closing system is designed as a structural unit. This is an advantage form a production engineering point of view, but the closing system is disposed in the door of the household appliance. Such an approach is disadvantageous because it considerably increases the weight of the door, which has an impact in particular on the design of the closing systems. Consequently, these closing systems must be made sturdier than would be necessary if they were installed into the body.

Further, DE 20 2006 010 482 U1 describes an assembly having a bearing for pivotally mounting a door or a hinged cover, in particular a door or a hinged cover of a refrigeration appliance. This assembly includes a frame or housing accommodating a plurality of components including, for example, the closing device itself, a damping device, as well as an opening-limiting device. This document does not provide any details on the installation of this assembly. Therefore, it may be assumed that the assembly is disposed conventionally in the hinge area of the door.

Modern refrigeration appliances are becoming increasingly large. The advantage of this is that they offer more space for the products to be stored in the interior compartment of the refrigeration appliance. However, the increasing size is associated with the disadvantage of increased weight of the door and the resulting consequences for the design of the existing opening and/or closing mechanisms. Moreover, today, such refrigeration appliances are no longer produced and sold only on a national scale. Rather, refrigeration appliances are marketed all over the world and must therefore meet different requirements. One very important aspect is the ability to flexibly select the hinge side of the door and thereby increase the diversity of variants. If it were possible to change the hinge side of the door, there would be no need to provide a plurality of appliance models for different installation environments. Overall, therefore, such an approach would lead to a simplification and standardization of the design of a refrigeration appliance.

SUMMARY

In an embodiment, the present invention provides a refrigeration appliance that comprises a body having an interior compartment, a door, and a door opening and/or closing mechanism for opening and/or closing the door that is adapted to act on the door. The interior compartment is adapted to receive products to be cooled. The door is movably attached to the body and adapted to close the interior compartment. The door opening and/or closing mechanism is an integral module and is disposed in a corresponding pocket of the refrigeration appliance.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
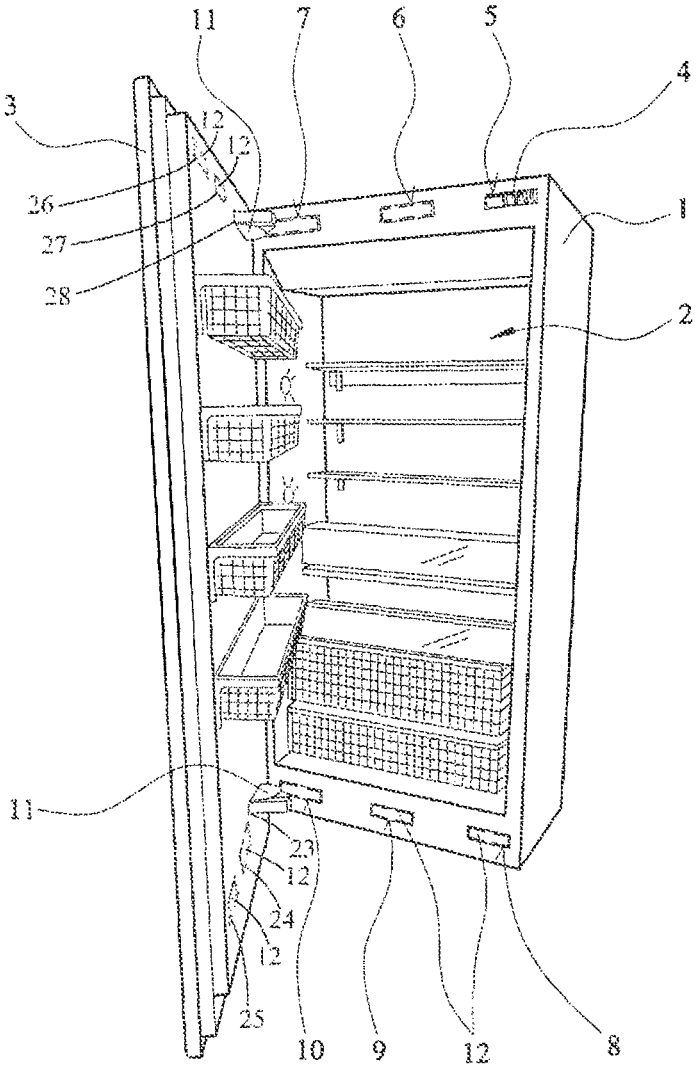
FIG. 1 is a perspective view of a refrigeration appliance having a plurality of pockets and an opening and/or closing mechanism.

An aspect of the present invention provides a refrigeration appliance which, being a standardized appliance, allows easy change of the hinge side of the door, but yet has an opening and/or closing mechanism that makes it easier for the user to open and/or close the door.

A refrigeration appliance having a body whose interior compartment receiving the products to be cooled can be closed by a door movably attached to the body, and further having at least one opening and/or closing mechanism acting on the door, is improved, according to the present invention, in that the opening and/or closing mechanism is inserted in a pocket receiving the opening and/or closing mechanism and is designed as an integral module.

A particular advantage offered by the present invention is that the installation of the opening and/or closing mechanism is significantly simplified because it is received in a pocket and designed as a module. In addition to this, the opening and/or closing mechanism is easily removed and reinstalled at a different location as a whole, for example, when it is necessary to change the hinge side of the door. This can be done with very little effort, even by the end user. Since the opening and/or closing mechanism is provided as a standardized module; i.e., as a unit, it may be prefabricated, thereby eliminating the need to assemble the opening and/or closing mechanism on the refrigeration appliance itself. It is also essential to the present invention that the opening and/or closing mechanism may be used for both hinged and sliding doors of a refrigeration appliance, which is why the present invention refers generally to "movable" doors.

In a first embodiment of the present invention, a plurality of identically configured pockets are provided along the contact area between the door and the body to receive an opening and/or closing mechanism and/or the hinges needed for mounting the door.

By providing a plurality of pockets, it is achieved in particular that the opening and/or closing mechanism can be installed in accordance with the requirements encountered. Thus, in other words, the opening and/or closing mechanism can be inserted in any of the identically configured pockets. This results in a large degree of standardization, and thus simplification of the entire refrigeration appliance.

In addition, the refrigeration appliance is significantly simplified and improved by the fact that the pockets of the present invention are suitable to receive also hinges provided between the door and the body of the refrigeration appliance. As a result, such hinges do not require any additional structural adaptations to be made to the refrigeration appliance. Generally, the opening and/or closing mechanism is disposed on a side of the body and/or door opposite the hinge, so that the pocket present at the hinge side can be easily used for hinge installation.

A further development of this approach according to other proposals of the present invention consists in that, along the contact area between the door and the body, one pocket is provided in each corner region of the refrigeration appliance and/or one pocket is provided centrally at the top and/or centrally at the bottom of the body or door of the refrigeration appliance. The plurality of individual pockets on the refrigeration appliance significantly increases the flexibility in changing the mounting position of the opening and/or closing mechanism, allowing it to be mounted both at a corner of the refrigeration appliance or centrally. Central mounting has the decisive advantage that the lever arm of the opening and/or closing mechanism can have a short length because the displacement can be selected to be relatively short as compared to mounting the opening and/or closing mechanism on the side opposite the hinge side. Consequently, this feature has a positive effect on the force to be employed, and thus on the design of the opening and/or closing mechanism. In addition, central mounting of the opening and/or closing mechanism is advantageous because it is independent of the required or intended hinge side of the door.

Furthermore, in order not to unnecessarily increase the weight of the door, it is proposed to incorporate the pockets into the insulating layer of the refrigeration appliance. In other words, the pockets are preferably disposed on the body in the peripheral region thereof. The insulating layer of a modern refrigeration appliance typically has a thickness that allows for easy installation of a pocket substantially without degrading the insulating effect. On the contrary, not only does this region offer sufficient space for installation, but arranging the pockets therein results in another very important advantage. When no opening and/or closing mechanism is disposed in such a pocket, then this pocket may be regarded as a special type of insulating layer because of its air volume since, as is known, air has a very low heat transfer coefficient and, therefore, acts thermally as an insulator. Thus, incorporation of the pockets even improves the insulation of the refrigeration appliance.

Moreover, for aesthetic and thermal reasons, it is advantageous if the pockets that are not equipped with an opening and/or closing mechanism are each closed by a cover. This cover is preferably given the same color as the refrigeration appliance, so that it recedes visually into the background. In addition, when made from plastic, these covers are inexpensive and simple to manufacture from a production engineering point of view. Insertion of the covers into the pockets that are not filled with an opening and/or closing mechanism may be accomplished in known manner with the aid of a latching, snap-fit or clamping connection.

In order to facilitate the changing of the opening and/or closing mechanism from one pocket to another, it is helpful to provide each pocket with standardized electrical contact elements for establishing contact with an opening and/or closing mechanism that may be inserted into the pocket. This allows the opening and/or closing mechanism to be changed without difficulty by removing it from a first pocket and inserting it into another. The contact elements may, in known manner, take the form of plugs or sockets.

A very specific embodiment of the present invention consists in that the opening and/or closing mechanism has an electric motor whose shaft carries a toothed ring in engagement with an axially movable toothed rack, whose axial movement, which can be produced in this way, can be used to act on the door, and that an overload coupling is disposed between the shaft and the toothed ring. This variant of the opening and/or closing mechanism is improved over prior art approaches in that it has an overload coupling which prevents damage to the opening and/or closing mechanism when, for example, an object or a person is present within the opening path of the door, blocking the opening movement of the door. Such a design is also advantageous when the refrigerator is closed and the opening and/or closing mechanism is actuated inadvertently. While, in such a situation, conventional opening and/or closing mechanisms suffer damage to their gears or toothed racks, which are typically made from plastic, this can be effectively prevented by the opening and/or closing mechanism according to the present invention. Since the entire opening and/or closing mechanism can be prefabricated as an integral module; i.e., as a unit, the overload coupling is also an integral part of this module, and therefore, overall significantly increases the life and safety of the refrigeration appliance, thereby improving the same. With such an on overload coupling, it is possible to prevent cost-intensive repairs.

In addition to the aforementioned advantages of the overload coupling, another advantage is that it is also capable of compensating for any tolerances in the alignment of the shaft of the electric motor with respect to the toothed ring.

In a refinement of this proposal, it is assumed that the overload coupling takes the form of a slip coupling. The fundamental advantage of a slip coupling is its almost wear-free operation. This results in a considerable increase in the life of the entire opening and/or closing mechanism and eliminates the need for replacement or repair of the opening and/or closing mechanism, which drastically reduces the operating costs of a refrigeration appliance equipped therewith.

Another embodiment of the present invention resides in a microswitch or sensor which periodically or permanently polls the position of the toothed rack or at least detects the respective end positions of the toothed rack to thereby ascertain the opening state of the door. In this way, it is possible to prevent the door of the refrigeration appliance from being inadvertently opened and left open, which could result in spoiling of the products stored in the refrigeration appliance. Moreover, it is possible to control the opening and/or closing mechanism in this manner.

In accordance with a further proposal of the present invention, in order to prevent damage to the surface on the inner side of the door, a damping buffer is disposed at the end of the toothed rack that acts on the door. This damping buffer is preferably made of a rubber material and facilitates smooth, noiseless contact between the end of the toothed rack and the inner side of the door.

Since, depending on the particular embodiment, the opening and/or closing mechanism can be used for both the opening movement and the closing movement of the door, another proposal of the present invention is to provide a magnet on or in the damping buffer. This magnet can be used in particular to improve the closing movement of the door. Naturally, a ferromagnetic region must be provided at the corresponding opposite surface of the door. In the simplest case, this may be a metallic section of the inner surface of the door. In this manner, in the event of unintentional activation; i.e., in the event the door is unintentionally thrown open, it can be ensured that the door is automatically closed; i.e, drawn onto the seal.

Furthermore, it is particularly advantageous if the magnet is integrated into the damping buffer. Full integration of the magnet into the damping buffer has the advantage that the magnet is not visible. In addition, this makes it is possible to prevent noise from being produced as the door is drawn onto the magnet and caused to adhere thereto.

The present invention will be described below in more detail with reference to the accompanying drawings. The exemplary embodiment shown is merely intended to illustrate the principle of the present invention, but should not be construed as limiting it to the variant shown.

Identical or similar components are denoted by the same reference numerals throughout. For the sake of illustrating the operating principle of the present invention, the figures are greatly simplified schematic views in which components not essential to the invention have been omitted. However, this does not mean that such components are not present in an approach in accordance with the present invention.

The refrigeration appliance shown in perspective view in FIG. 1 has a body 1 having an interior compartment 2 in which the products to be cooled can be stored. Interior compartment 2 can be closed by a door pivotally mounted to body 1. This door 3 is here hinged on the left side of the refrigeration appliance; which means that hinges 11 enabling the pivotal movement are mounted on the left side of the refrigeration appliance. In the example shown, one hinge 11 is located at the top of door 3, and one is located at the bottom of door 3, both serving for attachment to body 1 of the refrigeration appliance. The terms "top" and "bottom" as used herein refer to a refrigeration appliance in its normal operating position.

The special feature of the refrigeration appliance shown in FIG. 1 is that it has a plurality of pockets 5, 6, 7, 8, 9, 10 incorporated into the insulating layer of the refrigeration appliance along the wall periphery thereof, with pockets 7 and 10 forming receptacles for hinges 11 rotating into the pockets, and pocket 5 having an opening and/or closing mechanism 4 inserted therein, which enables and/or assist the opening movement of door 3. Pockets 6, 8, 9 are not occupied by an opening and/or closing mechanism or a hinge 11, but are each closed by a cover 12, so that they are not visually prominent. Door 3 includes a plurality of pockets 23, 24, 25, 26, 27, 28 incorporated into the periphery thereof, with pockets 23 and 28 housing hinges 11. Pockets 24, 25, 26, 27 are not occupied by an opening and/or closing mechanism or a hinge 11, but are each closed by a cover 12, so that they are not visually prominent.

Figure 2:
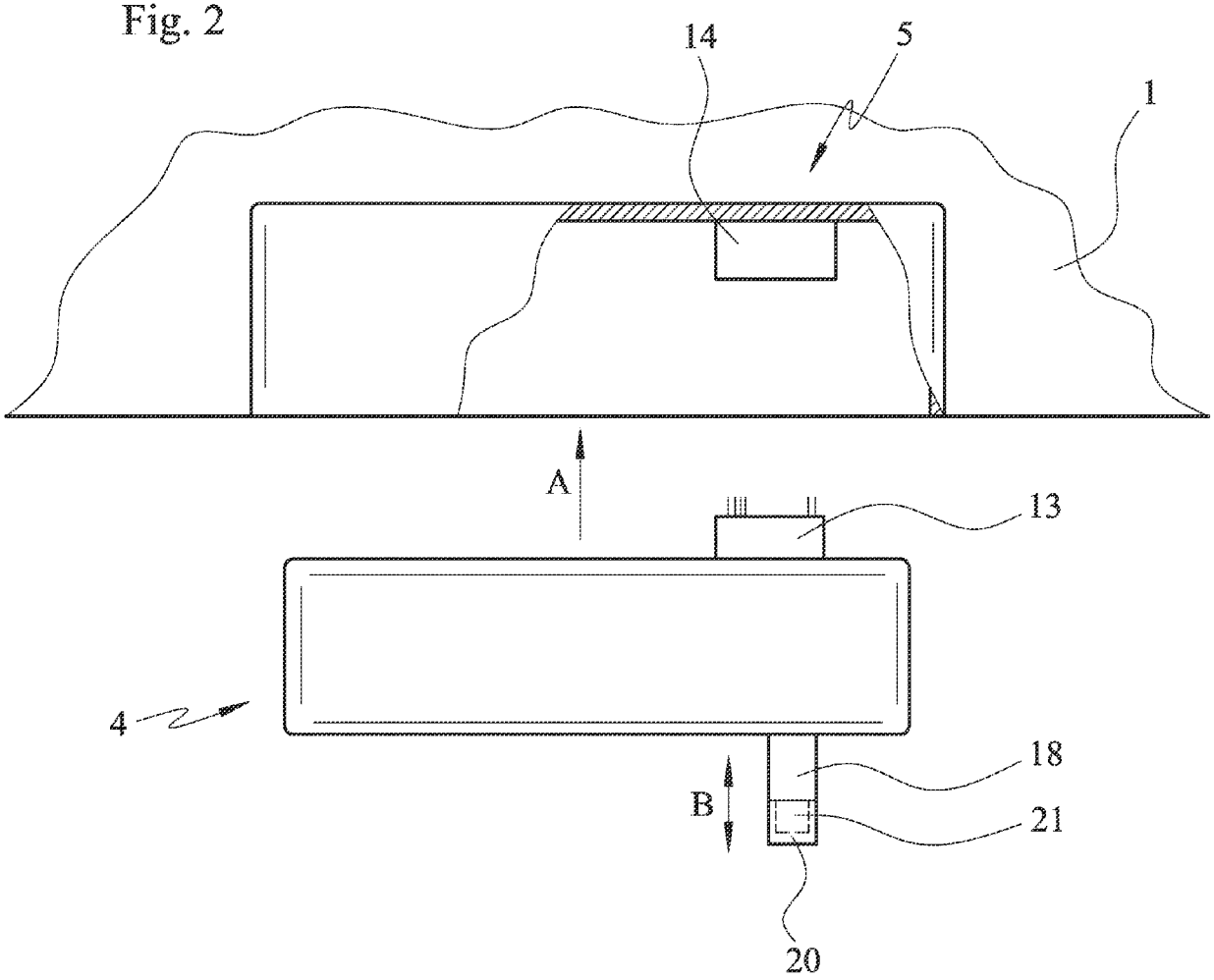
FIG. 2 is a partial exploded view showing an opening and/or closing mechanism and an associated pocket.

The purpose of the present invention is to design the opening and/or closing mechanism 4 as an integral and therefore easily replaceable module. FIG. 2 shows an exploded view illustrating the installation of such an opening and/or closing mechanism 4. Opening and/or closing mechanism 4 has a plug 13 provided on its rear side facing pocket 5. A socket 14 corresponding to this plug is provided in pocket 5, so that a plug-and-socket connection is established between plug 13 and socket 14 in the direction of arrow "A" when opening and/or closing mechanism 4 is accurately inserted into pocket 5. This very simple installation procedure allows opening and/or closing mechanism 4 to be replaced even by laymen and end users. This also allows the hinge side of door 3 to be changed in a simple manner when modifying the kitchen. Another advantage of this approach resides, for example, in the fact the body can be configured as a uniform, standardized element of the refrigeration appliance, and that during manufacture, no distinction needs to be made between left-hinged and right-hinged refrigeration appliances.

Opening and/or closing mechanism 4 further has a toothed rack 18 which is movable in the direction of double-headed arrow "B" and thus enables and/or assist the opening movement of door 3. The end of toothed rack 18 is provided with a damping buffer 20, which is here made of a rubber material and has integrated therein a magnet 21 to achieve a closing movement of door 3. Damping buffer 20 provides the advantage that no potentially disturbing noise is produced when toothed rack 18 abuts the inner side of door 3. It is obvious that the magnet 21 employed to achieve the closing movement of door 3 requires that a ferromagnetic surface or region is present on the corresponding opposite surface of door 3.

Figure 3:
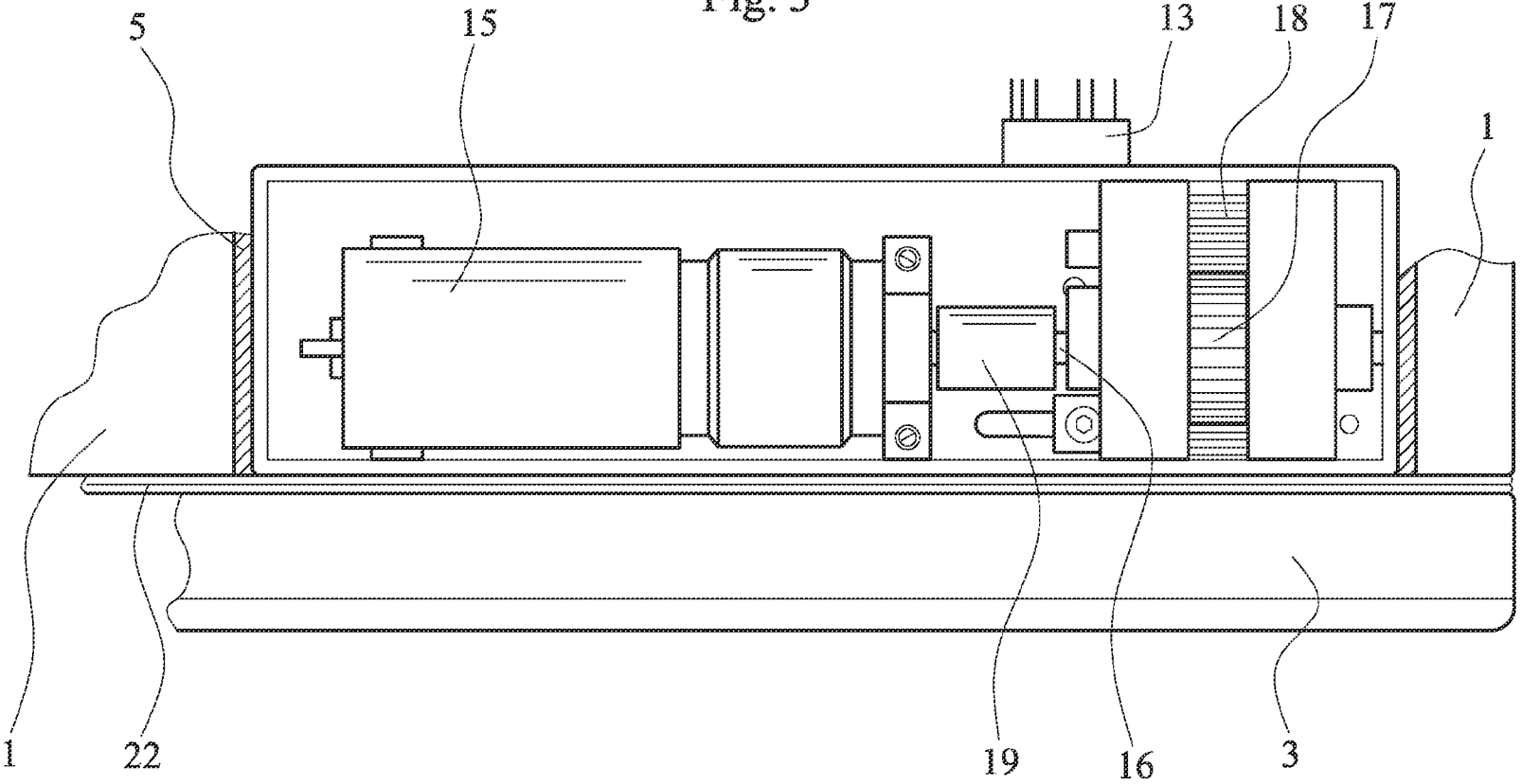
FIG. 3 is a partial view looking into a pocket and showing an opening and/or closing mechanism contained therein.

An example of a specific design of an opening and/or closing mechanism 4 is shown in FIG. 3, where an opening and/or closing mechanism 4 is inserted in a pocket 5 of the body 1 of the refrigeration appliance. In the embodiment shown, this opening and/or closing mechanism 4 has as an essential element an electric motor 15, whose rotating shaft 16 drives a toothed ring 17 mounted on shaft 16. Toothed ring 17 may also be a pinion and is in direct engagement with a corresponding toothed rack 18, so that rotation of toothed ring 17 causes axial movement of toothed rack 18. As a result of this axial movement of toothed rack 18, toothed rack 18 moves a specific distance out of opening and/or closing mechanism 4 and thus makes contact with the inner surface of door 3, whereupon it opens door 3 as it travels further. When viewed in the closing direction, toothed rack 18 moves away from door 3, thereby enabling a closing movement of door 3. Furthermore, a peripheral seal 22 is disposed between door 3 and body 1. The closing force of this seal, which results from the vacuum formed in interior compartment 2 of the refrigeration appliance, must be overcome by opening and/or closing mechanism 4. The vacuum formed in interior compartment 2 of the refrigeration appliance results from warm air which enters interior compartment 2 when the refrigeration appliance is opened and which cools after door 3 is closed, thereby producing the above-mentioned vacuum in the refrigeration appliance. As a result of this vacuum, door 3 is pressed more strongly against body 1 of the refrigeration appliance by the ambient air pressure. This enhances the sealing action of seal 22 between door 3 and body 1.

In order to prevent damage to opening and/or closing mechanism 4, the shaft 16 of the electric motor has an overload coupling 19, here in the form of a slip coupling. Thus, when an object hindering the opening movement of door 3 is present in front of the refrigeration appliance, then slip coupling 19 comes into operation, preventing damage to the mechanical components of opening and/or closing mechanism 4.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 body
2 interior compartment
3 door
4 opening and/or closing mechanism
5 pocket
6 pocket
7 pocket
8 pocket
9 pocket
10 pocket
11 hinge
12 cover
13 plug
14 socket
15 electric motor
16 shaft
17 toothed ring
18 toothed rack
19 overload coupling
20 damping buffer
21 magnet
22 seal
23 pocket
24 pocket
25 pocket
26 pocket
27 pocket
28 pocket

What is claimed is:

1. A refrigeration appliance comprising:

a body having an interior compartment adapted to receive products to be cooled;

a door movably attached to the body, the door being adapted to close the interior compartment; and an electric door opening and/or closing mechanism for opening and/or closing the door that is adapted to act on the door, the door opening and/or closing mechanism being an integral module and being disposed in a corresponding pocket of the refrigeration appliance, the integral module including a first plug-and-socket connector having a first electrical contact and the corresponding pocket including a second plug-and-socket connector disposed on a surface of the corresponding pocket, the second plug-and-socket connector having a second electrical contact configured to contact the first electrical contact in a plug-and-socket connection of the first and second plug-and-socket connectors established by an insertion of the integral module into the corresponding pocket, wherein the corresponding pocket is one of a plurality of identically configured pockets provided along a contact area between the door and the body, each of the plurality of identically configured pockets being configured to interchangeably receive either the door opening and/or closing mechanism or a hinge, and further comprising hinges respectively disposed in at least two of the plurality of pockets other than the corresponding pocket.

2. The refrigeration appliance as recited in claim 1 further comprising corner regions, wherein the plurality of pockets are respectively disposed at each corner region of the refrigerator appliance in the body or door of the refrigerator appliance.

3. The refrigeration appliance as recited in claim 1, wherein the corresponding pocket is incorporated into an insulating layer of the refrigeration appliance.

4. The refrigerator appliance as recited in claim 1, wherein the plurality of pockets are incorporated into an insulating layer of the refrigerator appliance.

5. The refrigeration appliance as recited in claim 1, wherein at least one of the plurality of pockets other than the corresponding pocket is closed by a cover.

6. The refrigeration appliance as recited in claim 1, wherein the door opening and/or closing mechanism includes an electric motor having a shaft with a toothed ring in engaging relation with an axially movable toothed rack, the toothed rack adapted to move axially so as to act on the door, and wherein an overload coupling is disposed between the shaft and the toothed ring.

7. The refrigeration appliance as recited in claim 6, wherein the overload coupling includes a slip coupling.

8. The refrigeration appliance as recited in claim 6 further comprising at least one of a microswitch or a sensor adapted to periodically poll the position of the toothed rack.

9. The refrigeration appliance as recited in claim 6 further comprising at least one of a microswitch or a sensor adapted to permanently poll the position of the toothed rack.

10. The refrigeration appliance as recited in claim 6, wherein a damping buffer is disposed at an end of the toothed rack so as to act on the door.

11. The refrigeration appliance as recited in claim 10, wherein the damping buffer is made of a rubber material.

12. The refrigeration appliance as recited in claim 10, wherein the damping buffer has a magnet adapted to improve a closing movement of the door.

13. The refrigeration appliance as recited in claim 12, wherein the magnet is integrated into the damping buffer.

14. The refrigeration appliance as recited in claim 10, wherein the damping buffer has a magnet adapted to improve the contact of the door against the body.

15. The refrigeration appliance as recited in claim 14, wherein the magnet is integrated into the damping buffer.

* * * * *